US007294113B1

(12) United States Patent
Wu

(10) Patent No.: US 7,294,113 B1
(45) Date of Patent: Nov. 13, 2007

(54) ECCENTRICALLY ROTATABLE MASSAGING DEVICE

(76) Inventor: Dong-Her Wu, 141, Chang Shui Rd., Sec. 2, Pu Yen Hsiang, Chang Hua Hsien (TW)

( * ) Notice: Subject to any disclaimer, the term of this patent is extended or adjusted under 35 U.S.C. 154(b) by 548 days.

(21) Appl. No.: 10/868,279

(22) Filed: Jun. 14, 2004

(51) Int. Cl.
*A61H 23/02* (2006.01)
*A61H 7/00* (2006.01)

(52) U.S. Cl. ..... 601/70; 601/72; 601/87; 601/93; 601/95; 601/112

(58) Field of Classification Search ..... 601/94, 601/95, 112–114, 85–88, 70, 72; 15/179, 15/180; 451/357
See application file for complete search history.

(56) References Cited

U.S. PATENT DOCUMENTS 958,939 A * 5/1910 Pyper ..... 601/87
2,431,979 A * 12/1947 Amer ..... 601/87
3,520,090 A * 7/1970 Lee ..... 451/357
5,305,738 A * 4/1994 Shimizu ..... 601/75
5,716,331 A * 2/1998 Chang ..... 601/50

FOREIGN PATENT DOCUMENTS

DE 3538970 A1 * 5/1987
GB 2274395 A * 7/1994

* cited by examiner

*Primary Examiner*—Danton DeMille
(74) *Attorney, Agent, or Firm*—Alan Kamrath; Kamrath & Associates P.A.

(57) ABSTRACT

A massaging device includes a housing, a motor, a cover, and an operation mechanism. The operation mechanism includes a rotation member secured on the rotation shaft of the motor to rotate therewith, and a massaging member pivotally mounted on the rotation member to move therewith. Thus, the massaging surface of the massaging member is rotated about the rotation shaft of the motor in an eccentric manner to move in the normal rotation direction and is rotated about the pivot shaft of the rotation member to move in the reverse rotation direction so as to provide a double massaging effect to the human body, thereby enhancing the massaging effect.

14 Claims, 8 Drawing Sheets

ECCENTRICALLY ROTATABLE MASSAGING DEVICE

BACKGROUND OF THE INVENTION

1. Field of the Invention

The present invention relates to a massaging device, and more particularly to an eccentrically rotatable massaging device.

2. Description of the Related Art

A conventional massaging device comprises a housing, a motor mounted in the housing and having a rotation shaft, and a contact member mounted on the rotation shaft of the motor and rotated by the rotation shaft of the motor in an eccentric manner. The contact member is rotated in concert with the rotation shaft of the motor, without producing relative displacement or rotation between the contact member and the rotation shaft of the motor. In operation, the rotation shaft of the motor is rotated to drive the contact member to rotate in an eccentric manner to touch and roll on a human body, thereby providing a massaging effect to the human body. However, the eccentrically rotated contact member is rotated at a high speed, so that the contact member rotated at a high speed easily produces a vibration to the human body, thereby causing an uncomfortable sensation to the user.

SUMMARY OF THE INVENTION

In accordance with the present invention, there is provided a massaging device, comprising a housing, a motor mounted in the housing and having a rotation shaft protruding outward from the housing, and an operation mechanism mounted on the rotation shaft of the motor, wherein:

the operation mechanism includes a rotation member secured on the rotation shaft of the motor to rotate therewith, and a massaging member pivotally mounted on the rotation member to move therewith;

the rotation member of the operation mechanism has a first end formed with a pivot shaft, a mediate portion formed with a mounting portion fixed on the rotation shaft of the motor to rotate therewith, and a second end formed with a counterweight; and the massaging member of the operation mechanism has a first side formed with a pivot portion pivotally mounted on the pivot shaft of the rotation member and a second side formed with a massaging surface.

The primary objective of the present invention is to provide an eccentrically rotatable massaging device.

Another objective of the present invention is to provide a massaging device, wherein the massaging surface of the massaging member is rotated about the rotation shaft of the motor in an eccentric manner to move in the normal rotation direction and is rotated about the pivot shaft of the rotation member to move in the reverse rotation direction so as to provide a double massaging effect to the human body, thereby enhancing the massaging effect.

A further objective of the present invention is to provide a massaging device, wherein the counterweight of the rotation member is used to reduce the rotation speed of the pivot shaft of the rotation member, thereby greatly enhancing the massaging effect.

A further objective of the present invention is to provide a massaging device, wherein when the massaging member is rotated, the limit portion of the massaging member is limited by the limit rod to stabilize rotation of the massaging member, thereby enhancing stability of the massaging effect.

Further benefits and advantages of the present invention will become apparent after a careful reading of the detailed description with appropriate reference to the accompanying drawings.

DETAILED DESCRIPTION OF THE INVENTION

Figure 1:
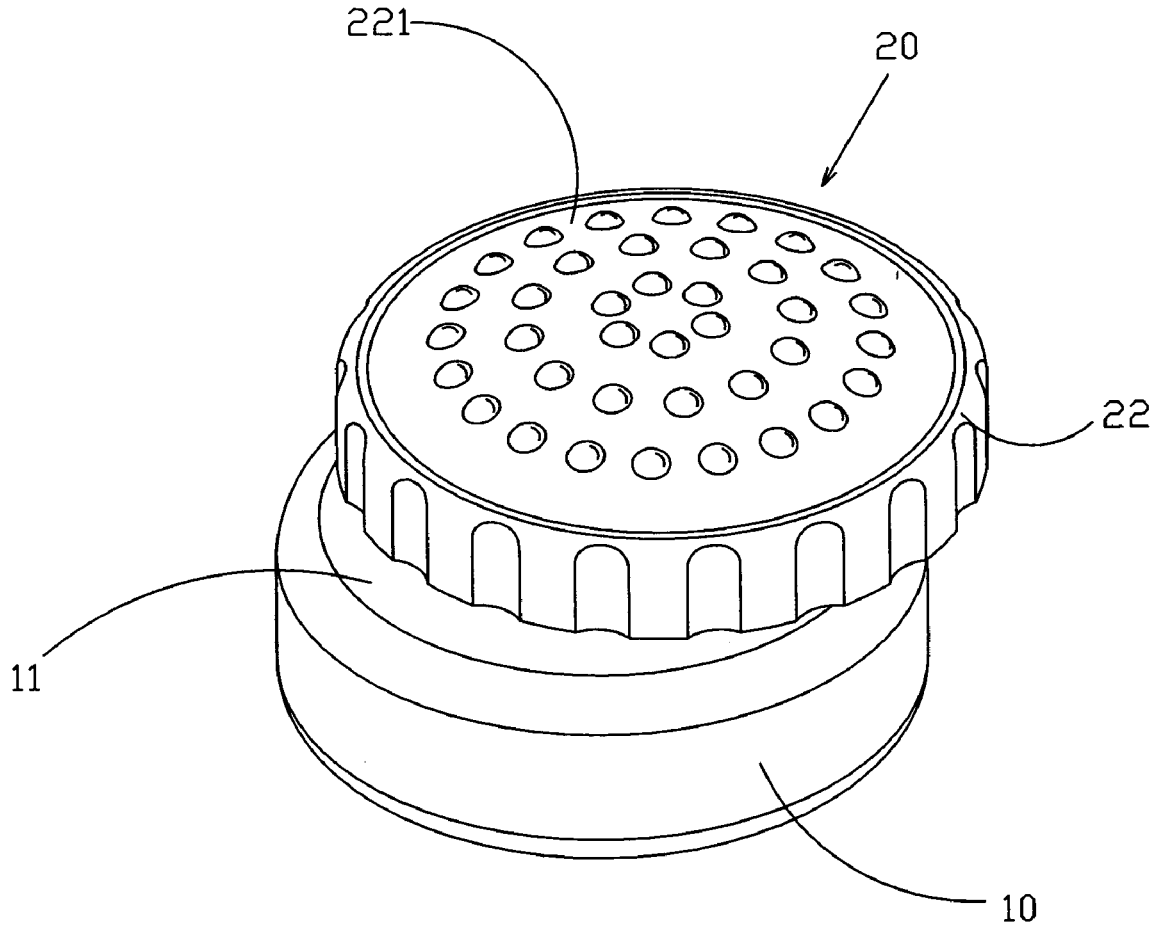
FIG. 1 is a perspective view of a massaging device in accordance with the preferred embodiment of the present invention.
Figure 2:
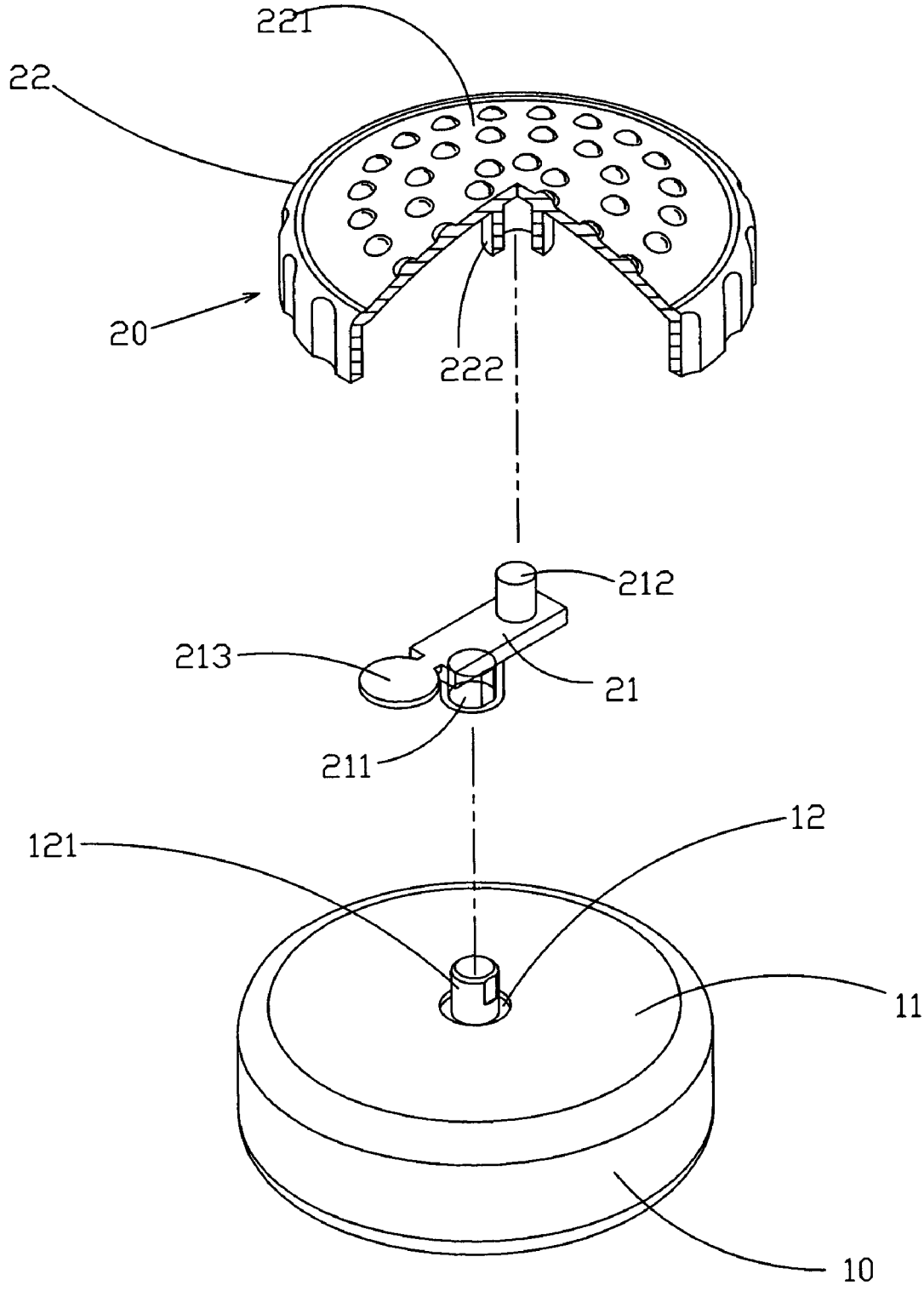
FIG. 2 is a partially cut-away exploded perspective cross-sectional view of the massaging device as shown in FIG. 1.
Figure 3:
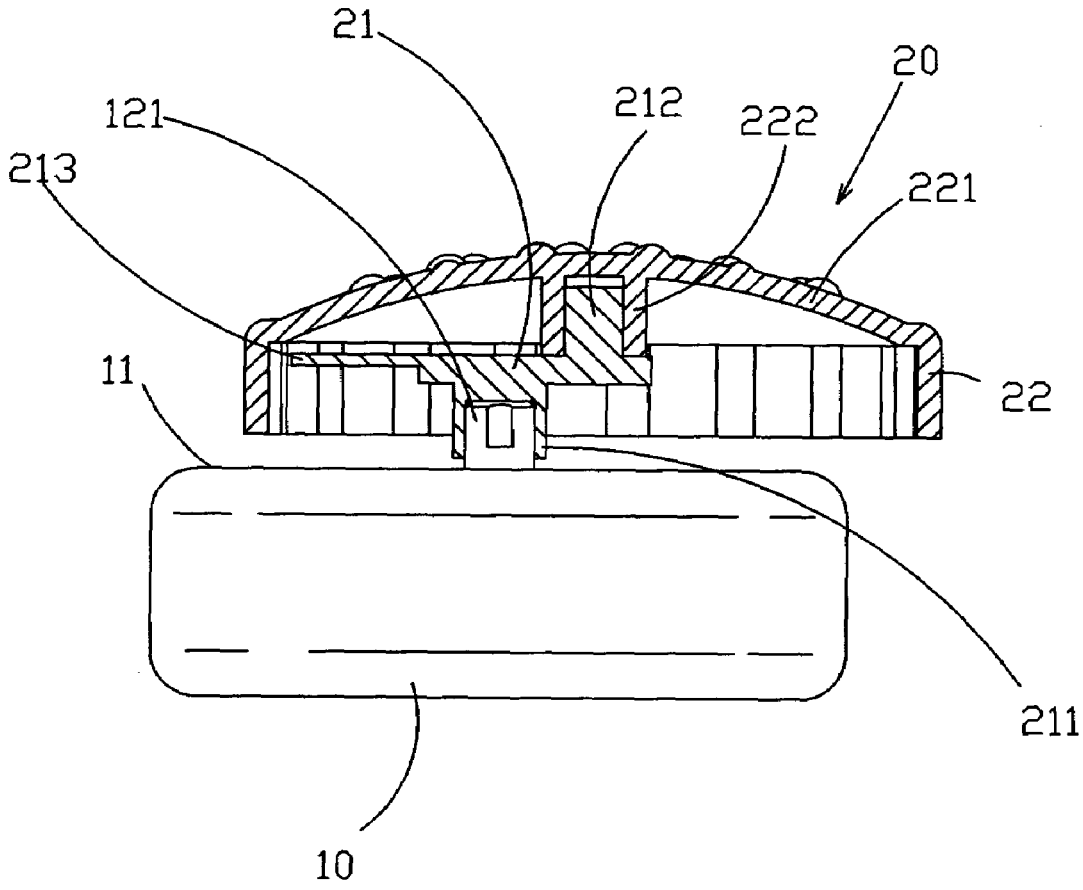
FIG. 3 is a plan cross-sectional view of the massaging device as shown in FIG. 1.

Referring to the drawings and initially to FIGS. 1-3, an eccentrically rotatable massaging device in accordance with the preferred embodiment of the present invention comprises a housing 10, a motor 12 mounted in the housing 10 and having a rotation shaft 121 protruding outward from the housing 10, a cover 11 mounted on the housing 10 to cover the motor 12, and an operation mechanism 20 mounted on the rotation shaft 121 of the motor 12.

The operation mechanism 20 includes a rotation member 21 secured on the rotation shaft 121 of the motor 12 to rotate therewith, and a massaging member 22 pivotally mounted on the rotation member 21 to move therewith.

The rotation member 21 of the operation mechanism 20 has a first end formed with a pivot shaft 212, a mediate portion formed with a mounting portion 211 fixed on the rotation shaft 121 of the motor 12 to rotate therewith, and a second end formed with a counterweight 213. The distance between the pivot shaft 212 and the mounting portion 211 is different from that between the counterweight 213 and the mounting portion 211. Thus, the pivot shaft 212 and the counterweight 213 are located at two opposite sides of the mounting portion 211 in an asymmetric manner.

The massaging member 22 of the operation mechanism 20 has a first side formed with a pivot portion 222 pivotally mounted on the pivot shaft 212 of the rotation member 21 and a second side formed with a massaging surface 221. The pivot portion 222 of the massaging member 22 is mounted on the pivot shaft 212 of the rotation member 21 to rotate therewith and is rotatable relative to the pivot shaft 212 of the rotation member 21. In addition, the massaging member 22 of the operation mechanism 20 is located eccentrically relative to the rotation shaft 121 of the motor 12.

In such a manner, when the mounting portion 211 of the rotation member 21 is rotated by the rotation shaft 121 of the motor 12, the pivot shaft 212 of the rotation member 21 is rotated to rotate the pivot portion 222 of the massaging member 22, so that the massaging surface 221 of the massaging member 22 is rotated about the rotation shaft 121 of the motor 12 in an eccentric manner to move in the normal rotation direction.

When the massaging surface 221 of the massaging member 22 touches a human body, a reaction from the human body is applied on the massaging surface 221 of the massaging member 22 to drive the pivot portion 222 of the massaging member 22 to rotate on the pivot shaft 212 of the rotation member 21, so that the massaging surface 221 of the massaging member 22 is rotated about the pivot shaft 212 of the rotation member 21 to move in the reverse rotation direction.

Thus, the massaging surface 221 of the massaging member 22 is rotated about the rotation shaft 121 of the motor 12 in an eccentric manner to move in the normal rotation direction and is rotated about the pivot shaft 212 of the rotation member 21 to move in the reverse rotation direction so as to provide a double massaging effect to the human body, thereby enhancing the massaging effect. In addition, the counterweight 213 of the rotation member 21 is used to reduce the rotation speed of the pivot shaft 212 of the rotation member 21, thereby enhancing the massaging effect.

Figure 4:
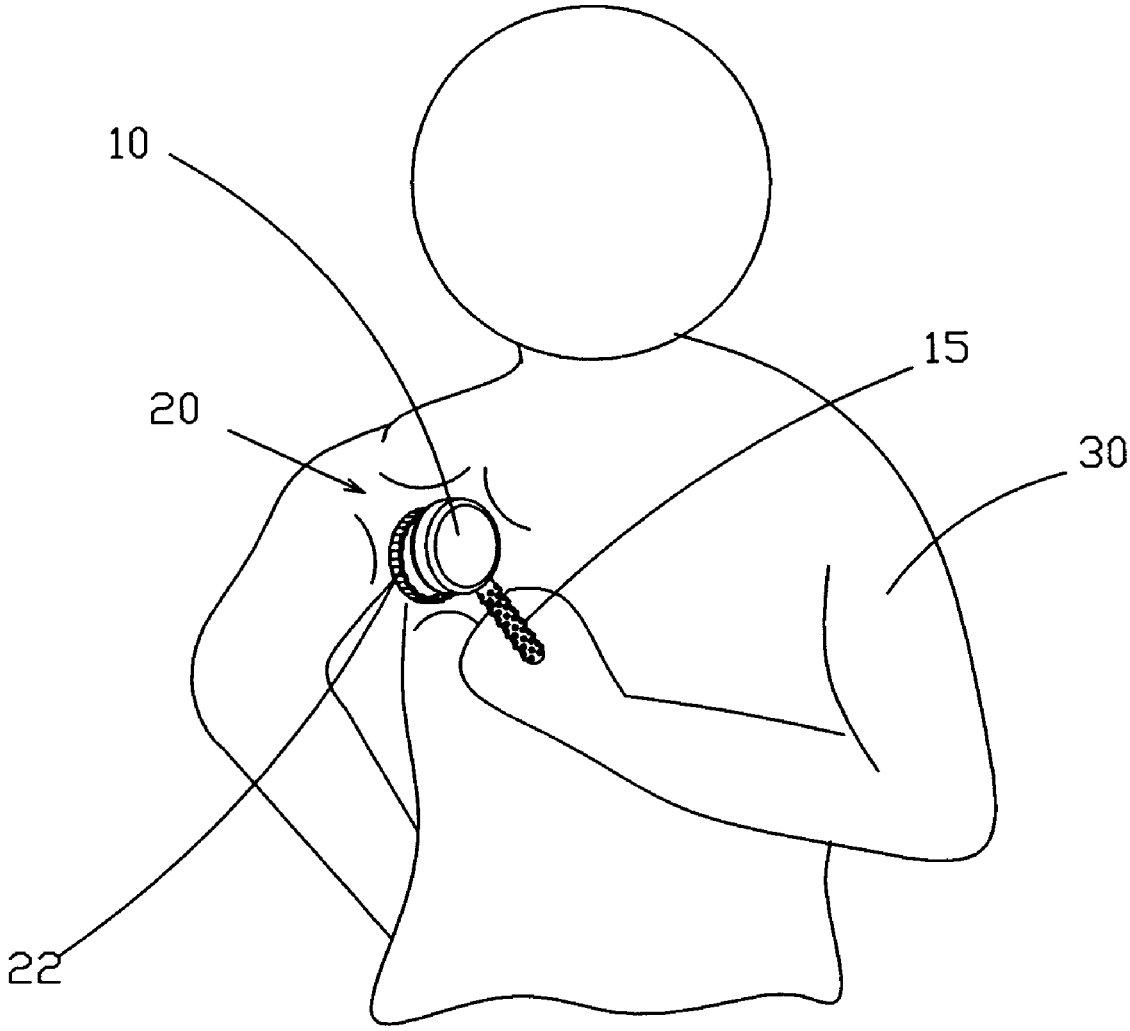
FIG. 4 is a schematic operational view of the massaging device as shown in FIG. 1 in use.

As shown in FIG. 4, the massaging device is used to provide a massaging effect to a human body 30. In addition, the massaging device further comprises a handle 15 mounted on a periphery of the housing 10 to facilitate the user holding the massaging device.

Figure 5:
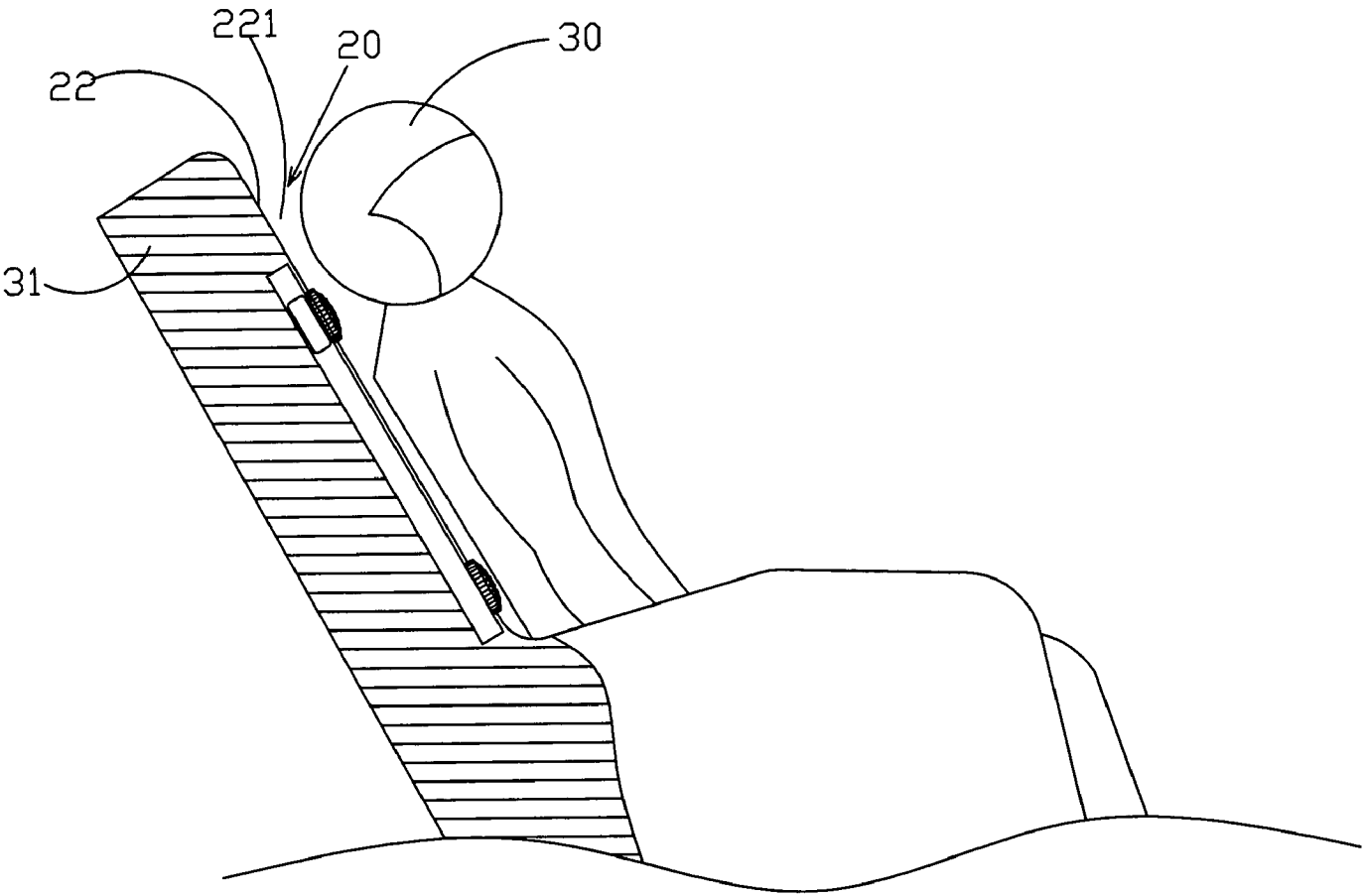
FIG. 5 is a schematic operational view of the massaging device as shown in FIG. 1 in use.

As shown in FIG. 5, the massaging device is mounted on a seat backrest 31 to provide a massaging effect to a human body 30.

Figure 6:
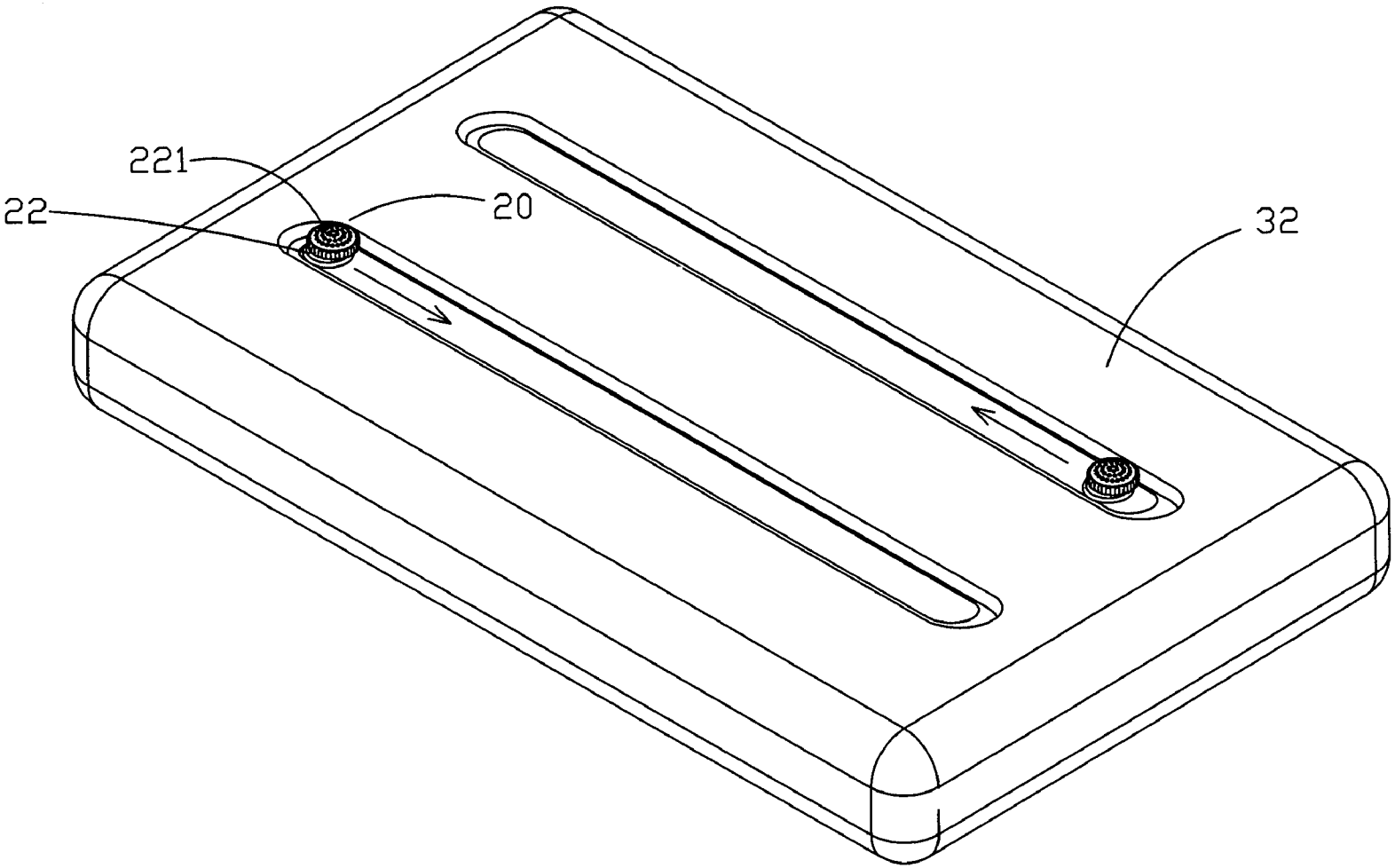
FIG. 6 is a schematic operational view of the massaging device as shown in FIG. 1 in use.

As shown in FIG. 6, the massaging device is mounted on a bed cushion 32 to provide a massaging effect to a human body.

Figure 7:
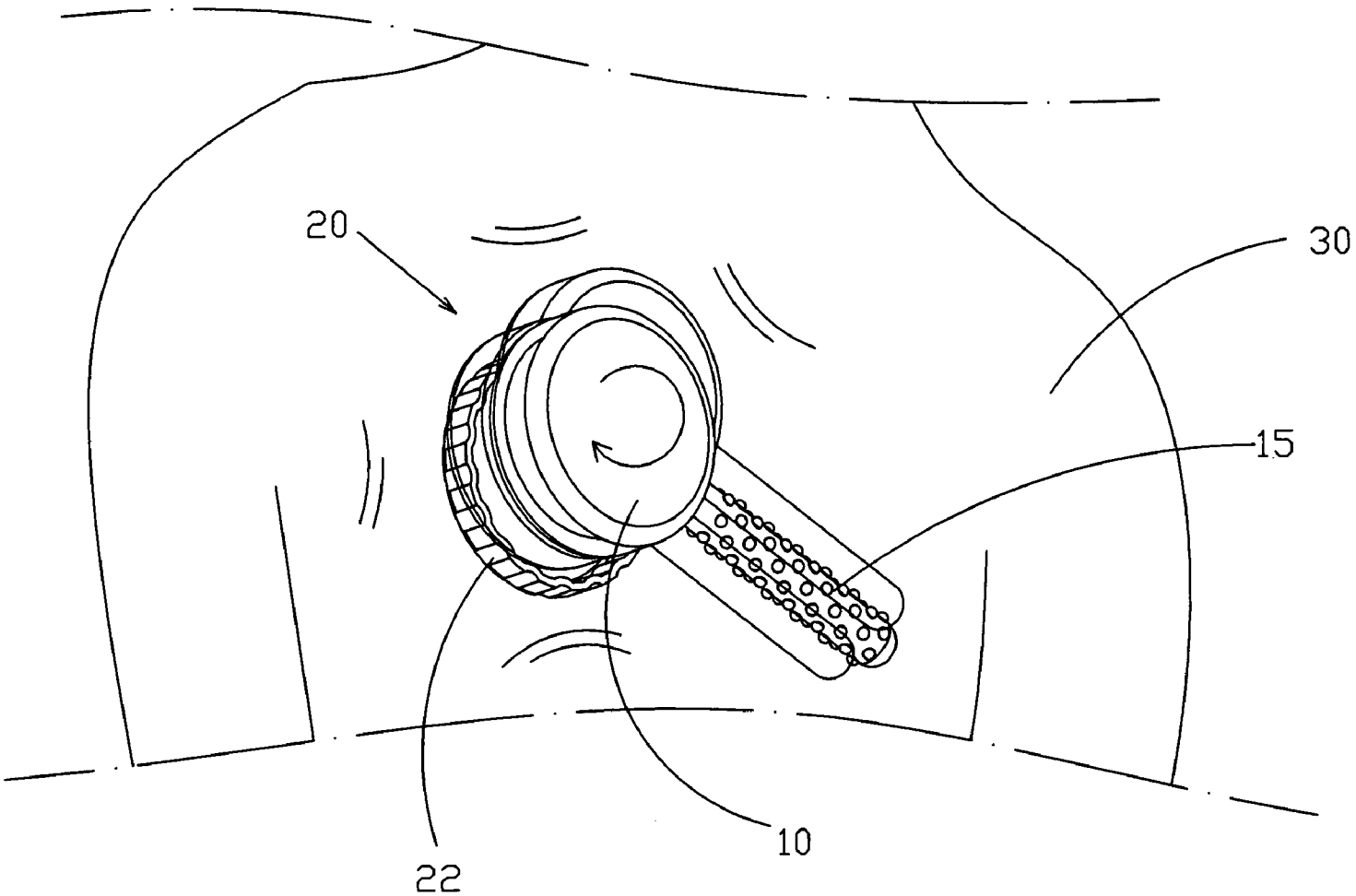
FIG. 7 is a schematic operational view of the massaging device as shown in FIG. 1 in use.

As shown in FIG. 7, the massaging member 22 is rotated in an eccentric manner.

Figure 8:
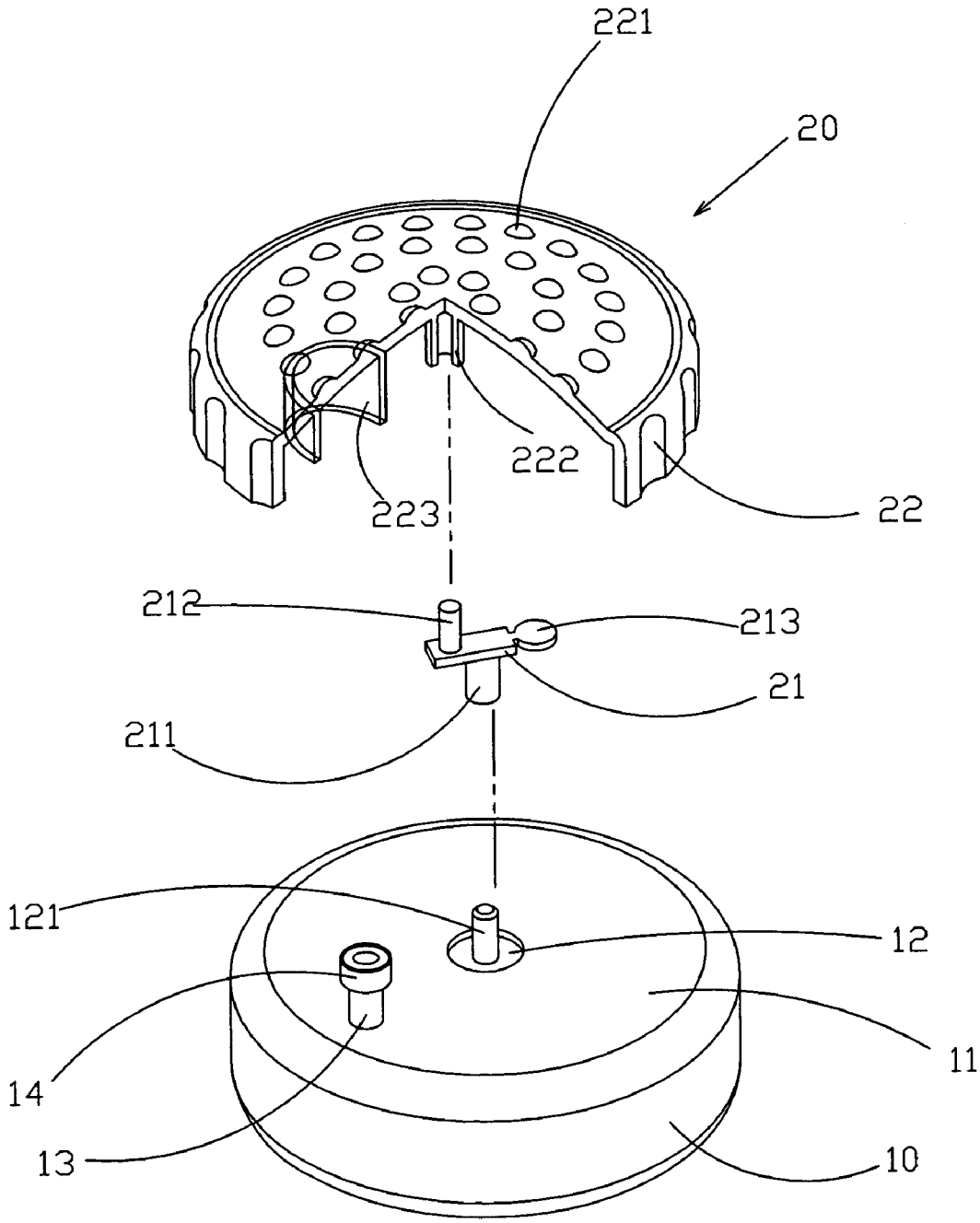
FIG. 8 is a partially cut-away exploded perspective cross-sectional view of a massaging device in accordance with another embodiment of the present invention.

As shown in FIG. 8, the first side of the massaging member 22 is formed with an arc-shaped limit portion 223, and the housing 10 is provided with a protruding limit rod 13 mounted in the limit portion 223 of the massaging member 22. The limit rod 13 has an end formed with a bearing 14 rested on the limit portion 223 of the massaging member 22. Thus, when the massaging member 22 is rotated, the limit portion 223 of the massaging member 22 is limited by the limit rod 13 to stabilize rotation of the massaging member 22, thereby enhancing stability of the massaging effect.

Accordingly, the massaging surface 221 of the massaging member 22 is rotated about the rotation shaft 121 of the motor 12 in an eccentric manner to move in the normal rotation direction and is rotated about the pivot shaft 212 of the rotation member 21 to move in the reverse rotation direction so as to provide a double massaging effect to the human body, thereby enhancing the massaging effect. In addition, the counterweight 213 of the rotation member 21 is used to reduce the rotation speed of the pivot shaft 212 of the rotation member 21, thereby greatly enhancing the massaging effect. Further, when the massaging member 22 is rotated, the limit portion 223 of the massaging member 22 is limited by the limit rod 13 to stabilize rotation of the massaging member 22, thereby enhancing stability of the massaging effect.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A massaging device, comprising a housing, a motor mounted in the housing and having a rotation shaft protruding outward from the housing, and an operation mechanism mounted on the rotation shaft of the motor, wherein:

the operation mechanism includes a rotation member secured on the rotation shaft of the motor to rotate therewith, and a massaging member pivotally mounted on the rotation member to move therewith;

the rotation member of the operation mechanism has a first end formed with a pivot shaft, a mediate portion formed with a mounting portion fixed on the rotation shaft of the motor to rotate therewith, and a second end formed with a counterweight;

the massaging member of the operation mechanism has a first side formed with a pivot portion pivotally mounted on the pivot shaft of the rotation member and a second side formed with a massaging surface;

the first side of the massaging member is formed with a limit portion, and the housing is provided with a protruding limit rod mounted in the limit portion of the massaging member;

the limit portion of the massaging member is rotatable with the massaging member and rotatable relative to the limit rod of the housing when the massaging member is rotatable relative to the housing.

2. The massaging device in accordance with claim 1, wherein a distance between the pivot shaft and the mounting portion is different from that between the counterweight and the mounting portion.

3. The massaging device in accordance with claim 1, wherein the pivot shaft and the counterweight are located at two opposite sides of the mounting portion in an asymmetric manner.

4. The massaging device in accordance with claim 1, wherein the pivot portion of the massaging member is protruded from the first side of the massaging member and has a hollow inside pivotally mounted on the pivot shaft of the rotation member to rotate therewith.

5. The massaging device in accordance with claim 1, wherein the pivot portion of the massaging member is rotatable relative to the pivot shaft of the rotation member when the massaging member is rotatable relative to the housing.

6. The massaging device in accordance with claim 1, wherein the pivot portion of the massaging member of the operation mechanism is located eccentrically relative to the rotation shaft of the motor.

7. The massaging device in accordance with claim 1, wherein when the mounting portion of the rotation member is rotated by the rotation shaft of the motor, the pivot shaft of the rotation member is rotated eccentrically to rotate the pivot portion of the massaging member eccentrically relative to the rotation shaft of the motor, so that the massaging surface of the massaging member is rotated about the rotation shaft of the motor in an eccentric manner.

8. The massaging device in accordance with claim 1, wherein the massaging surface of the massaging member is rotated about the pivot shaft of the rotation member.

9. The massaging device in accordance with claim 1, further comprising a handle mounted on a periphery of the housing.

10. The massaging device in accordance with claim 1, wherein the limit portion of the massaging member is a substantially arc-shaped plate which is spaced from the limit rod of the housing.

11. The massaging device in accordance with claim 1, wherein the limit rod of the housing has an end formed with a bearing rested on the limit portion of the massaging member when the massaging member is rotatable relative to the housing.

12. The massaging device in accordance with claim 11, wherein the bearing of the limit rod is spaced from the housing.

13. The massaging device in accordance with claim 11, wherein the bearing of the limit rod has a diameter grater than that of the limit rod.

14. The massaging device in accordance with claim 1, wherein the limit portion of the massaging member is arranged eccentrically relative to the pivot portion of the massaging member.

* * * * *